US006697601B1

(12) United States Patent
Kamimura et al.

(10) Patent No.: US 6,697,601 B1
(45) Date of Patent: Feb. 24, 2004

(54) IMAGE FORMING DEVICE HAVING SHEET SENSORS

(75) Inventors: Masahiro Kamimura, Nagoya (JP); Kazumasa Makino, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/295,957

(22) Filed: Nov. 18, 2002

(30) Foreign Application Priority Data

Nov. 20, 2001 (JP) ..... 2001-354902

(51) Int. Cl.[7] ..... G03G 15/00
(52) U.S. Cl. ..... 399/388; 399/393
(58) Field of Search ..... 399/388, 389, 399/393, 396; 271/4.03, 10.03, 258.01, 259

(56) References Cited

U.S. PATENT DOCUMENTS 5,678,127 A * 10/1997 Suga ..... 399/389
5,722,029 A * 2/1998 Tomidokoro et al. ..... 399/389
5,775,683 A * 7/1998 Rodi
5,848,784 A * 12/1998 Tranquilla ..... 271/10.03
6,148,172 A * 11/2000 Kanda et al. ..... 399/396
6,324,377 B2 * 11/2001 Ando et al.

FOREIGN PATENT DOCUMENTS

JP A 10-35941 2/1998

* cited by examiner

*Primary Examiner*—Arthur T. Grimley
*Assistant Examiner*—Ryan Gleitz
(74) *Attorney, Agent, or Firm*—Oliff & Berridge, PLC

(57) ABSTRACT

An image forming device feeding one cut sheet consecutively from a feeding unit to a image forming unit where a printed image is formed on the cut sheet. During feeding, a uniform interval between a trailing edge of a preceding sheet and a leading edge of a subsequent sheet is maintained. By setting a nip area between a sheet supply roller and a separating pad as a reference position for separating one sheet from a stack of sheet in the feeding unit. Sheet leading edge sensors including a light projecting element and a light receiving element are positioned downstream from the reference position exactly a distance L0. When the leading edge of a subsequent sheet is detected by the leading edge sensors and found to be less than a prescribed interval from the trailing edge of the preceding sheet, the feed timing for the subsequent sheet is delayed a prescribed amount.

12 Claims, 6 Drawing Sheets

IMAGE FORMING DEVICE HAVING SHEET SENSORS

BACKGROUND OF THE INVENTION

The present invention relates to an image forming device such as laser printers, photocopiers, facsimile machines, and more particularly to an electrophotographic type image forming device provided with sheet sensors.

A conventional electrophotographic type image forming device, such as a laser printer, has been disclosed, for example, in laid open Japanese patent application publication No. HEI-10-35941. In this type of image forming device, a toner image formed on a photosensitive drum is transferred to a sheet or another recording medium as the medium passes between a transfer roller and the photosensitive drum. Subsequently, the recording medium passes between a single heat roller and a single pressure roller, causing the toner to melt by heat and fixing the toner image to the surface of the recording medium. A feeder unit is provided for supplying the recording medium stacked in a sheet supply tray, one sheet at a time. The sheet of the recording medium is conveyed from the feeder unit to an image forming position at which the photosensitive drum opposes the transfer roller through a conveying path by a sheet supply roller, a plurality of intermediate conveying rollers, and a register roller provided along the conveying path.

When forming images on a plurality of recording mediums in succession, the start timing for supplying the second and subsequent sheets from the feeder unit is set as follows. If the trailing edge of the preceding sheet is too close to the leading edge of the following sheet, sheet sensors disposed along the conveying path from the feeder unit to a discharging unit may mistakenly detect a sheet jam if the leading edge of the following sheet is conveyed over a sheet sensor before the sheet sensor detects the trailing edge of the preceding sheet. To prevent the detection of such sheet jam and also to secure enough time for developing the image data, normally the start timing for supplying sheets is set such that an interval of a prescribed amount, for example approximately 60 mm, is provided between the trailing edge of the preceding sheet and the leading edge of the following sheet.

For supplying each one sheet from the feeder unit, a frictional separating mechanism is used for separating the one sheet from the remaining sheet stack. One such frictional separating mechanism employs a separation pad pressing against the sheet supply roller to generate friction for separating the sheets. However, sometimes the leading edges of the sheets in the feeder unit become uneven. When using such frictional separating mechanism, a following sheet can oppose the frictional force between the sheet supply roller and frictional separating pad and move in the conveying direction as the preceding sheet is conveyed due to attractive force between the preceding uppermost sheet and the subsequent lower sheet stacked in the sheet supply tray. In this case, the subsequent sheet stops with its leading edge shifted downstream in the conveying direction from a reference position at the nip area between the sheet supply roller and frictional separating pad when the sheet supply roller has stopped.

If the following sheet stops with its leading edge shifted too far downstream from the reference point at the nip area when the sheet supply roller stops, the required condition of maintaining a prescribed interval between neighboring sheets cannot be met. Hence, when the sheet supply roller is driven to rotate at a prescribed timing designed to maintain a prescribed interval between sheets, it is possible that the sheet sensors will detect a sheet jam as described above or that sufficient time is not allocated for developing the image data to be printed.

SUMMARY OF THE INVENTION

In view of the foregoing, it is an object of the present invention to provide an image forming device capable of forming images at appropriate positions on a recording medium, while maintaining a fast processing speed. This and other objects will be attained by an improved image forming device including an image forming unit, a feeder unit, a leading edge sensor, and a control unit. An image is formed on an image recording medium at the image forming unit. The feeder unit accommodates therein a stack of a plurality of image recording mediums. The feeder unit includes a sheet supply member that separates one image recording medium from a remaining stack, and feeds each one image recording medium toward the image forming unit in succession in a medium feeding direction with an interval between a trailing edge of a precedent image recording medium and a leading edge of a subsequent image recording medium. The leading edge sensor detects each leading edge of each image recording medium fed by the feeder unit. The lead edge sensor is communicated with the control unit, and the control unit controls a driving timing of the sheet supply member for controlling a feed start timing to feed the image recording medium based on the detection by the leading edge sensor.

BRIEF DESCRIPTION OF THE DRAWINGS

In the drawings:

FIG. 4(*b*) is a plan view showing the leading edge sensor according to the first embodiment;

FIG. 7(*b*) is a plan view showing the leading edge sensor according to the second embodiment.

DESCRIPTION OF THE PREFERRED EMBODIMENTS

Figure 1:
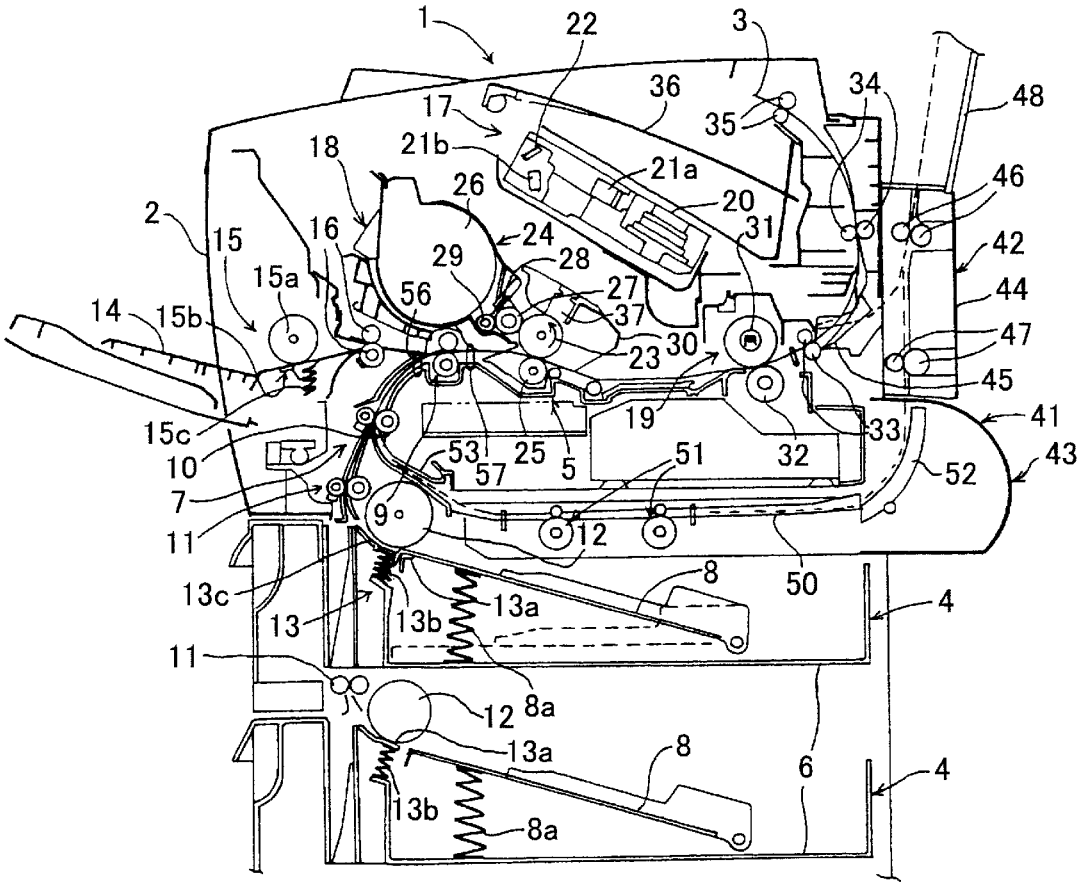
FIG. 1 is a side cross-sectional view showing the general construction of a laser printer according to the first embodiment of the present invention.

An image forming device according to a first embodiment of the present invention will be described with reference to FIGS. 1 through 6. The following description pertains to a laser printer 1 embodying the invention. As shown in FIG. 1, the laser printer 1 includes a main case 2. The main case 2 accommodates a plurality of feeder units 4 for supplying a sheet 3 serving as the recording medium, an image forming unit 5 for forming prescribed images on the conveyed sheet 3, and the like.

Each feeder unit 4 is provided with a sheet supply tray 6 detachably mounted on the bottom of the main case 2, a sheet pressure plate 8 provided inside the sheet supply tray 6, and a sheet supply roller 12 and separation pad 13 disposed at the top and on one end of the sheet supply tray 6. A conveying path 7 via which the sheet 3 is conveyed from the sheet supply roller 12 to an image forming position (the point of contact between a photosensitive drum 23 and a transfer roller 25, that is, the transfer position) is formed in a curve as shown in FIG. 1. Provided at suitable intervals along the conveying path 7, beginning in order from the upstream end, are the sheet supply roller 12, pairs of intermediate conveying rollers 11 and 10, and a register roller 9 disposed just prior to the image forming position and downstream from the intermediate conveying rollers 10 in the conveying direction.

A register sensor 56 is disposed near the register roller 9 and on the upstream side thereof. An image timing sensor 57 is provided downstream from the register roller 9 for detecting a timing required for developing the image data.

The end of the pressure plate 8 farthest from the sheet supply roller 12 is pivotably supported, enabling the end nearest the sheet supply roller 12 to move up and down. A spring 8*a* disposed on the underside of the pressure plate 8 urges the free end of the pressure plate 8 upward. The sheet supply roller 12 and separating pad 13 are disposed in opposition to each other. The separating pad 13 includes a pad support 13*c*, a spring 13*b* disposed on the underside of the pad support 13*c*, and a separating pad 13*a* provided with a large coefficient of friction that applies pressure on the sheet supply roller 12 through the urging force of the spring 13*b*.

The widthwise dimensions of the separating pad 13*a* and sheet supply roller 12 in the direction orthogonal to the conveying direction are shorter than the width dimension of the sheet 3. When the sheet 3 is conveyed, the separating pad 13*a* and the sheet supply roller 12 contact only approximately the widthwise center of the sheet 3. The uppermost sheet among the sheet 3 stacked on the pressure plate 8 is pressed against the sheet supply roller 12. The rotations of the sheet supply roller 12 cause a single sheet on top of the stack to be introduced between the sheet supply roller 12 and separating pad 13 one at a time. The single sheet of sheet 3 interposed between the sheet supply roller 12 and separating pad 13 is then conveyed by the intermediate conveying rollers 11 to the intermediate conveying rollers 10 and register roller 9 in order. After being properly registered by the register roller 9, the sheet 3 is conveyed to the image forming position.

Provided on one side of the main case 2 at a position above the top feeder unit 4 are a multipurpose tray 14 for supplying the sheet 3 by hand and a multipurpose feeder unit 15. The unit 15 includes a multipurpose sheet supply roller 15*a*, a multipurpose pad 15*b* for feeding the sheet 3 stacked in the multipurpose tray 14, and a spring 15*c*. The spring 15*c* is disposed on the underside of the multipurpose pad 15*b* for urging the multipurpose pad 15*b* toward the multipurpose sheet supply roller 15*a*. When a sheet of the sheet 3 stacked on the multipurpose tray 14 is introduced between the rotating multipurpose sheet supply roller 15*a* and the multipurpose pad 15*b*, a single sheet is conveyed to the register roller 9 via a pair of conveying rollers 16.

The image forming unit 5 is provided with a scanning unit 17, a processing unit 18, and a fixing unit 19. The scanning unit 17 is disposed in the top portion of the main case 2 beneath a discharge tray 36. The scanning unit 17 includes a laser light emitting unit (not shown), a rotatably driven polygon mirror 20, lenses 21*a* and 21*b*, and a reflecting mirror 22. A laser beam emitted from the laser light emitting unit based on prescribed image data passes through or is reflected by the polygon mirror 20, lens 21*a*, reflecting mirror 22, and lens 21*b* in order. The resulting light is irradiated in a high-speed scan onto the surface of the photosensitive drum 23, serving as the photosensitive member (image-bearing member) in the processing unit 18.

The processing unit 18 includes a drum cartridge 30 and a developing cartridge 24. The drum cartridge 30 assembles therein the photosensitive drum 23, a scorotoron charger 37, and a transfer roller 25. The developing cartridge 24 is detachably mounted on the drum cartridge 30. The developing cartridge 24 includes a toner accommodating unit 26, a developing roller 27, a toner thickness regulating blade 28, and a toner supply roller 29.

The toner accommodating unit 26 is filled with a developing agent, which in the present embodiment is a positively chargeable, nonmagnetic, single-component polymer toner. The toner is supplied to the developing roller 27 by the toner supply roller 29, and is positively charged through friction generated between the toner supply roller 29 and developing roller 27. As the developing roller 27 rotates, the toner carried on the developing roller 27 is scraped by the toner thickness regulating blade 28, thereby forming a thin layer of toner having uniform thickness on the surface of the developing roller 27. The rotating photosensitive drum 23 is disposed in opposition to the developing roller 27 and is grounded. The surface of the photosensitive drum 23 has a positively chargeable photosensitive layer formed of polycarbonate or another organic photosensitive material.

In this type of laser printer 1, residual toner remaining on the surface of the photosensitive drum 23 is recovered by the developing roller 27, after the toner image is transferred to the sheet 3 from the photosensitive drum 23 by the transfer roller 25. This toner collection is so called a cleanerless system. By recovering residual toner on the surface of the photosensitive drum 23 using this cleanerless system, it is not necessary to provide a blade or other cleaning device nor a storage device for collecting discarded toner, thereby simplifying the construction of the device and facilitating size and cost reductions.

The scorotoron charger 37 is disposed above the photosensitive drum 23 and is spaced away therefrom a prescribed distance so as not to contact the surface of the same. The scorotoron charger 37 is a positive charging scorotoron charger having a charging wire formed of tungsten or the like from which a corona discharge is generated. The scorotoron charger 37 is configured to charge the entire surface of the photosensitive drum 23 with a uniform positive polarity.

As the photosensitive drum 23 rotates, the scorotron charger 37 generates a positive charge across the entire surface of the photosensitive drum 23. Subsequently, the surface of the photosensitive drum 23 is exposed to the high-speed scanning of a laser beam emitted from the scanning unit 17, forming an electrostatic latent image on the surface based on prescribed image data.

Next, the positively charged toner carried on the surface of the developing roller 27 is brought into contact with the photosensitive drum 23 as the developing roller 27 rotates. At this time, the electrostatic latent images formed on the surface of the photosensitive drum 23 are transformed into visible images when the toner is selectively attracted to portions of the photosensitive drum 23 that were exposed to the laser beam and, therefore, have a lower potential than the rest of the uniformly charged surface. In this way, a reverse image (toner image) is formed.

The transfer roller 25 is disposed below the photosensitive drum 23 and in opposition thereto and is rotatably supported on the drum cartridge 30 to rotate in the clockwise direction of FIG. 1. The transfer roller 25 includes a metal roller shaft covered by a roller that is formed of a rubber material having ionic conductivity. A transfer bias applying power source is configured to apply a forward bias voltage to the transfer roller 25 during image transfers. As a result, the visible image (toner image) carried on the surface of the photosensitive drum 23 is transferred to the sheet 3 as the sheet 3 passes between the photosensitive drum 23 and transfer roller 25.

Next, as shown in FIG. 1, the fixing unit 19 is disposed to the side of and downstream from the processing unit 18. The fixing unit 19 includes a single heat roller 31, a pressure roller 32 applying pressure to the single heat roller 31, and a pair of conveying rollers 33 disposed downstream from the single heat roller 31 and pressure roller 32. The single heat roller 31 is formed of aluminum or another metallic material and is provided with a halogen lamp or other heater. The heat from the single heat roller 31 fixes the toner transferred to the sheet 3 in the processing unit 18 to the sheet 3 as the sheet 3 passes between the single heat roller 31 and the pressure roller 32. Subsequently, the sheet 3 is conveyed by the conveying rollers 33, a pair of conveying rollers 34, and a pair of discharge rollers 35 on the sheet discharge end of the conveying path and is discharged onto the discharge tray 36.

In the present embodiment, the laser printer 1 is provided with a reconveying unit 41 for forming images on the backside of the sheet 3. The reconveying unit 41 is integrally configured of a reversing mechanism 42 and a reconveying tray 43. The reversing mechanism 42 is attached to the back end of the main case 2, while the reconveying tray 43 is detachably mounted in the main case 2 and is insertable over the top feeder unit 4.

The reversing mechanism 42 includes a casing 44 having a substantially rectangular cross-section. The casing 44 is mounted on the outside of the back panel of the main case 2. The reversing mechanism 42 also includes a flapper 45, a pair of reverse rollers 46, and a pair of reconveying rollers 47 disposed inside the casing 44. A reverse guide plate 48 protrudes upward from the top end of the casing 44. The reconeying unit 41 also includes a tray 50, skewed rollers 51, a curved guide plate 52 and a reconveying guide plate 53.

The flapper 45 is pivotally movably provided near to and downstream from the conveying rollers 33 in the back of the main case 2. Upon energization or deenergization of an electromagnetic solenoid (not shown), the sheet 3 having an image formed on one side surface and conveyed by the conveying rollers 33 can be selectively guided toward either the conveying rollers 34 or the reverse rollers 46. When discharging the sheet 3 printed on one side to the discharge tray 36, the flapper 45 is pivotally moved upward. When printing both sides of the sheet 3, the flapper 45 is pivotally moved toward the reverse rollers 46. The reverse rollers 46 are capable of rotating both forward and backward. When the sheet 3 is interposed between the pair of reverse rollers 46, the reverse rollers 46 are first rotated in the forward direction, conveying the sheet 3 toward the reverse guide plate 48. Subsequently, the sheet 3 is conveyed backward to the reconveying rollers 47 by the reverse rotation of the reverse rollers 46. The reconveying rollers 47 convey the sheet 3 down a curved guide plate 52 in the reconveying tray 43 and onto the tray 50. The skewed rollers 51 on top of the tray 50 convey the sheet 3 along the tray 50, while maintaining the side edge of the sheet 3 in contact with an aligning plate (not shown). The sheet 3 is conveyed via the reconveying guide plate 53 back to the intermediate conveying roller 10. Through this process, the sheet 3 is reversed such that its unprinted surface is facing up at the location of the intermediate conveying rollers 10 and the register roller 9. Hence, as the sheet 3 passes by the image forming position, images can be formed on the back side of the sheet 3.

Figure 2:
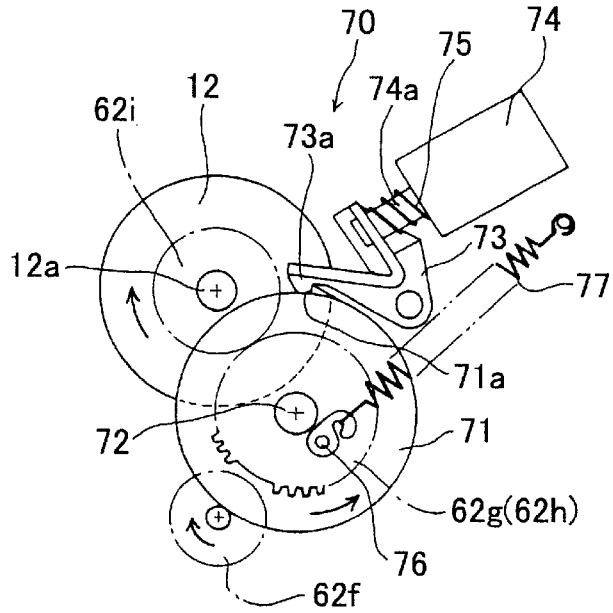
FIG. 2 is a side view showing a clutch mechanism for intermittently driving a sheet supply roller in the first embodiment.
Figure 3:
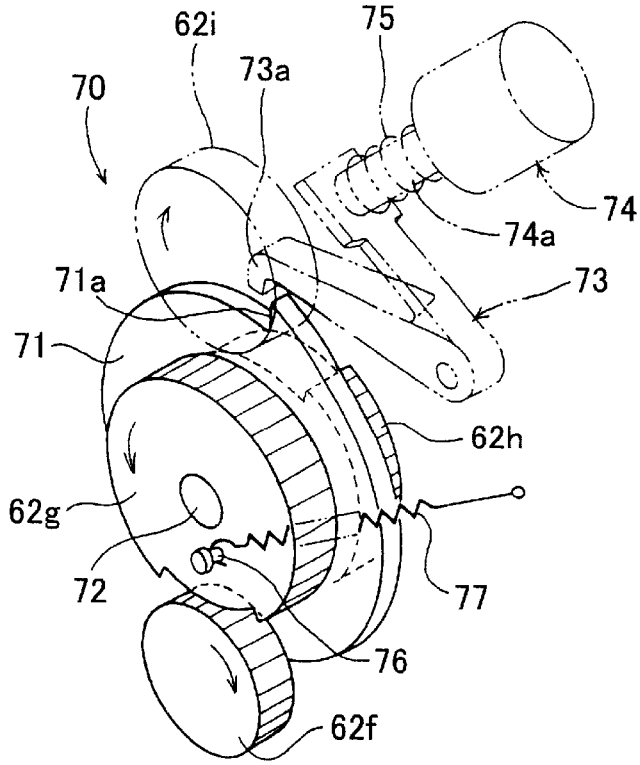
FIG. 3 is a perspective view showing the clutch mechanism of FIG. 2.

As shown in FIGS. 2 and 3, a clutch mechanism 70 is provided for selectively transmitting driving force to the sheet supply roller 12. A first transmission gear set includes notched gears 62*g* and 62*h*, and a cam disk 71 formed integrally between the notched gears 62*g* and 62*h*. The cam disk 71 is provided with an engaging step 71*a*. The notched gears 62*g* and 62*h* and cam disk 71 are fixed on a shaft 72. The notched gear 62*g* is disposed opposite an intermediate gear 62*f* on the driving side, while the notched gear 62*h* opposes a followerside gear 62*i* provided coaxially with a shaft 12*a* of the sheet supply roller 12. A pivoting engaging lever 73 is capable of contacting or separating from the circumferential surface of the cam disk 71. One end of the engaging lever 73 is linked with a rod 74*a* of an electromagnetic solenoid 74 serving as an actuator. An engaging pawl 73*a* is provided on another end of the pivoting engaging lever 73. The engaging pawl 73*a* is urged toward the circumferential surface of the cam disk 71 by a spring 75 to engage with the engaging step 71*a*. One end of a rotation urging spring 77 is rotatably linked to an eccentric shaft 76 disposed on the side surface of the notched gear 62*g* (or notched gear 62*h*), while the other end of the spring 77 is connected to a frame (not shown). The rotation urging spring 77 functions to urge the notched gears 62*g* and 62*h* and cam disk 71 as a single unit to rotate in the counterclockwise direction of FIG. 2.

Rotation phases of these gears 62*f*, 62*g*, 62*h* and 62*i* are set such that when the engaging pawl 73*a* of the engaging lever 73 engages the engaging step 71*a* of the cam disk 71, stopping the rotation of the cam disk 71, the intermediate gear 62*f* is positioned across from the notched part of the notched gear 62*g* and the teeth of the two gears are disengaged from each other. Similarly, the follower-side gear 62*i* is positioned across from the notched part of the notched gear 62*h*, with the teeth of these two gears disengaged. In this state, the rotational driving force of a first driving motor 63 (see FIG. 5) is not transferred to the follower-side gear 62*i*, enabling the follower-side gear 62*i*, and consequently the sheet supply roller 12, to rotate freely (idle spinning).

Ordinarily, at the beginning of a sheet feed operation, the electromagnetic solenoid 74 is temporarily (intermittently) energized upon receiving a prescribed signal, causing the rod 74*a* to draw into the electromagnetic solenoid 74 against the urging force of the spring 75. At this time, the engaging pawl 73*a* disengages from the engaging step 71*a*. The urging force of the rotation urging spring 77 causes the cam disk 71 and the notched gear 62*g* (notched gear 62*h*) to rotate in the counterclockwise direction of FIGS. 2 and 3, enabling the teeth of the notched gear 62*g* to engage with the intermediate gear 62*f* and transfer its rotational driving force, while the notched gear 62*h* engages with the follow-side gear 62*i*, transferring a rotational force to the sheet supply roller 12.

Since the energization of the electromagnetic solenoid 74 is temporary, the engaging pawl 73*a* is maintained in sliding contact with the circumferential surface of the cam disk 71 by the urging force of the spring 75 upon deenergization of the electromagnetic solenoid 74. After the cam disk 71 completes one rotation, the engaging pawl 73*a* is brought into engagement with the engaging step 71*a*, stopping rotational transfer.

In this non-power transmission state, the sheet supply roller 12 can still spin idly. Therefore, when the leading edge of the sheet 3 is conveyed between the pair of intermediate conveying rollers 11 and the like downstream, the sheet 3 is conveyed smoothly downstream, even when the back end of the sheet 3 is interposed between the sheet supply roller 12 and separating pad 13, because of the idle rotation of the sheet supply roller 12.

Figure 4A:
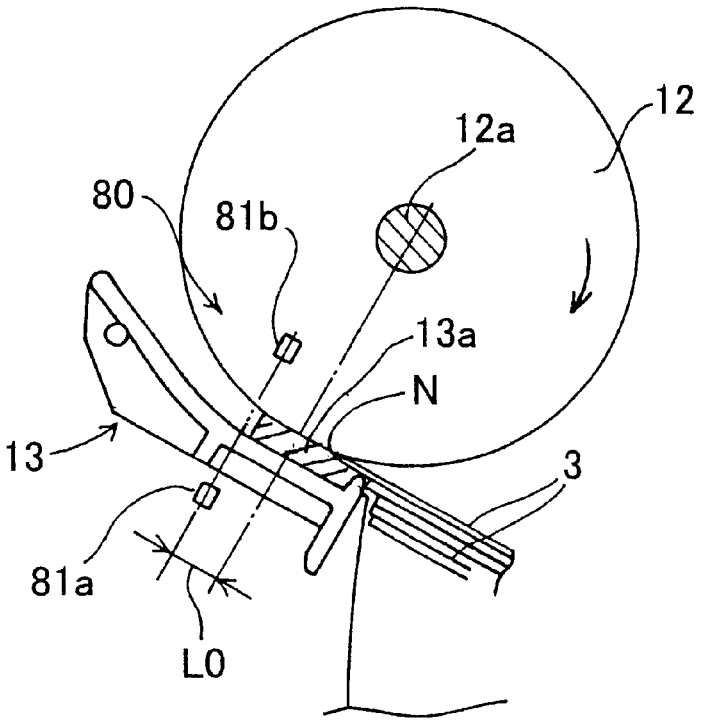
FIG. 4(*a*) is a side view showing a leading edge sensor according to the first embodiment.
Figure 4B:
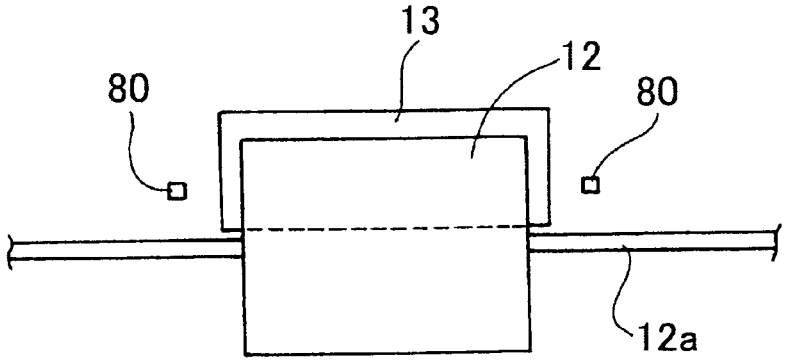

As described above, widths of the sheet supply roller 12 and separation pad 13 are smaller in the direction orthogonal to the conveying direction of the sheet 3 than the width of the sheet 3, and the sheet supply roller 12 and the separation pad 13 contact only the approximate widthwise center of the sheet 3. A pair of leading edge sensors 80, 80 is disposed on the widthwise left and widthwise right sides of the separating pad 13*a* and sheet supply roller 12 for detecting the position of the leading edge of the sheet 3 as shown in FIGS. 4(*a*) and 4(*b*). Here, the leading edge sensors 80, 80 are a plurality of pairs of non-contact sensors, such as light transmission sensors. Each of the left and right pair of the leading edge sensors 80, 80 includes light emitting element 81*a* disposed at a lower surface side of the sheet 3, and a light receiving element 81*b* disposed at the upper surface side of the sheet 3. Thus, an optical path between the elements 81*a* and 81*b* extends across the consheet conveying path.

The peripheral surface of the sheet supply roller 12 and the separating pad 13*a* provide a sheet nipping area as shown in FIG. 4(*a*), and a reference position N is set at an upstream part of the nipping area in the sheet conveying direction. The pair of left and right leading edge sensors 80, 80 are disposed exactly a distance L0 downstream from the reference position N, as shown in FIG. 4(*a*). According to the present embodiment, the distance L0 is approximately 7.5 mm. Instead of the light transmission type sensors 80, 80, available are light reflection type sensors having a light emitting element and a light receiving element those positioned on one of the left and right sides of the sheet supply roller 12.

The leading edge sensors 80 only need be disposed downstream from the reference position N, and therefore, installation number of the leading edge sensors can be reduced, creating a more compact device.

Figure 5:
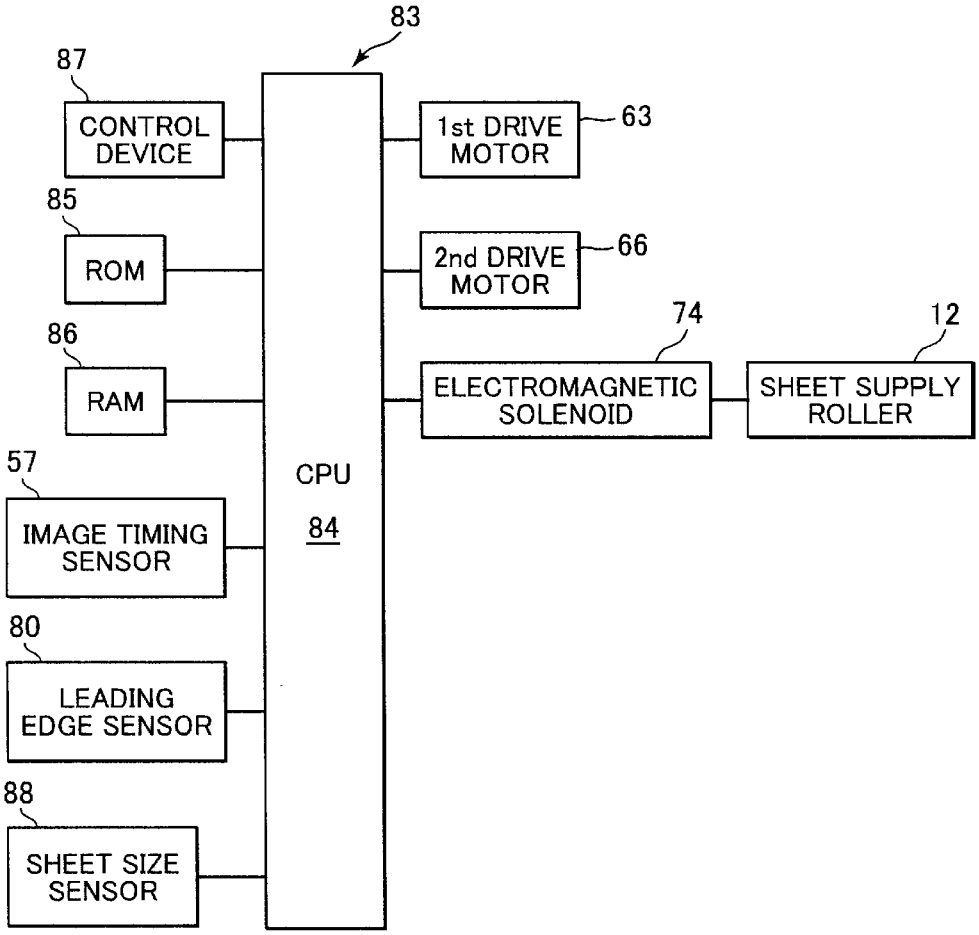
FIG. 5 is a block diagram showing the functions of a controller in the first embodiment.

Next, sheet conveying control using the pair of leading edge sensors 80 will be described. FIG. 5 shows a control arrangement for this purpose. An electronic controller, such as a microcomputer is used as a controller 83. The controller 83 includes a central processing unit (CPU) 84 for executing various operations, for example, for controlling the timing at which the sheet supply rollers are driven (feed start timing) and the like, The controller 83 also includes a read only memory (ROM) 85 for storing control programs and the like, a random access memory (RAM) 86 for temporarily storing various data, an input/output (I/O) interface (not shown), and the like. Image data, image forming commands, and other data are transmitted from a master control device 87, such as a host computer.

External output system devices including the first driving motor 63, a second drive motor 66, and the electromagnetic solenoid 74 are connected to the CPU 84 via the output interface (not shown). The first driving motor 63 is adapted for driving the sheet supply roller 12 and the intermediate conveying roller 11 downstream from the sheet supply roller 12. The second drive motor 66 is adapted for driving other mechanisms downstream from the register roller 9 and processing unit 18. The electromagnetic solenoid 74 is adapted for switching the sheet supply roller 12 between driving phase and non-driving phase. Further, external input system devices, including the image timing sensor 57, the pair of leading edge sensors 80, and a sheet size sensor 88 in the feeder units 4, are connected to the CPU 84 via the input interface (not shown).

Figure 6:
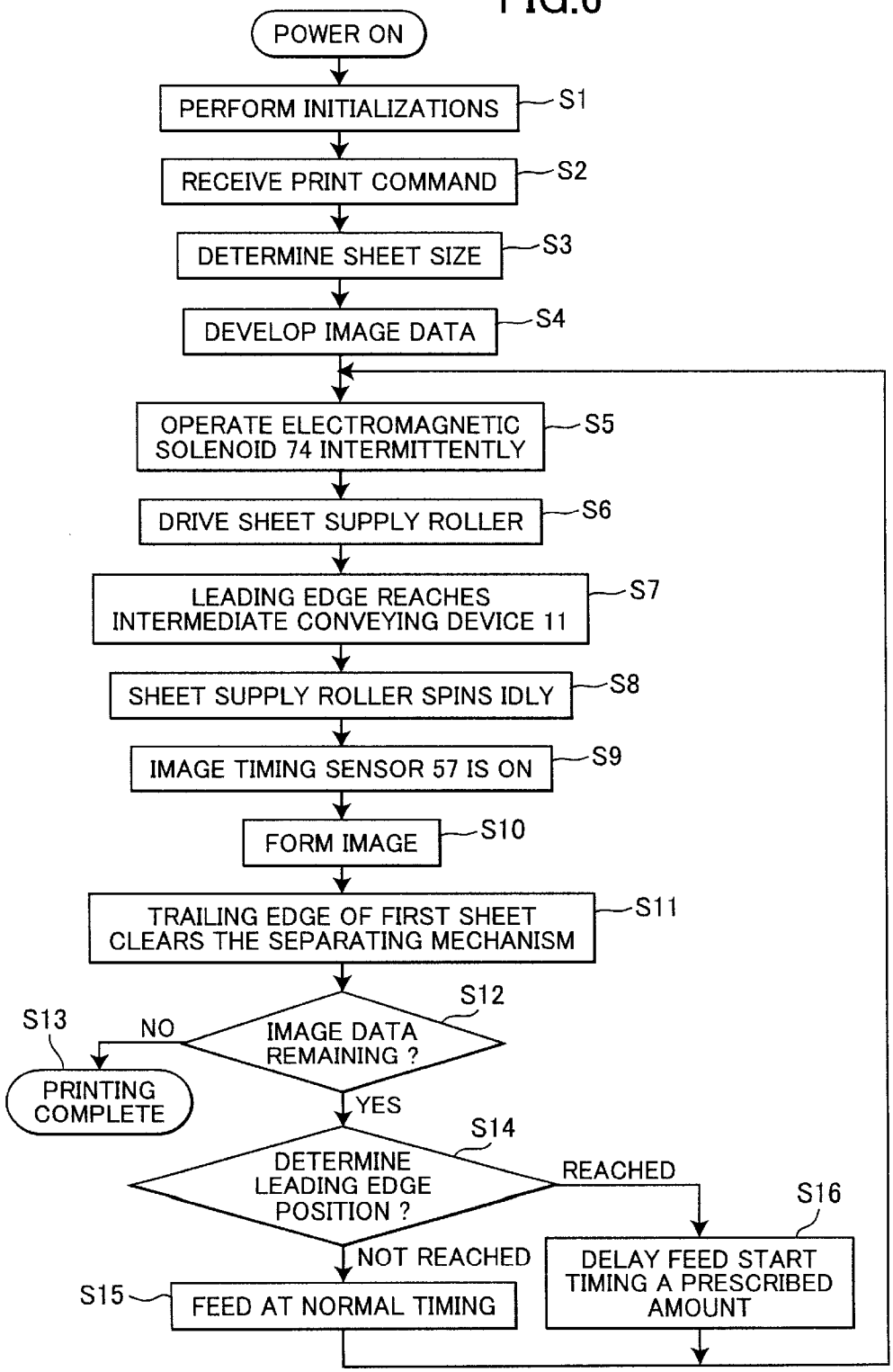
FIG. 6 is a flowchart outlining the control process for maintaining a uniform interval between sheets, the process being executed in the first embodiment.

Next, the process for controlling sheet convey will be described with reference to the flowchart in FIG. 6. When the power is turned on, initial operations are executed in S1. That is, the first driving motor 63, second drive motor 66, and the like began operating, rotating the photosensitive drum 23 and transfer roller 25 in the processing unit 18, the developing roller 27, the heat roller 31, the intermediate conveying rollers 10 and 11, and the like. Further, the heater in the heat roller 31 is also turned on. During these initial operations, the electromagnetic solenoid 74 is set to the deenergization state (OFF) so that motive power of the first driving motor 63 is not transmitted to the sheet supply roller 12.

When a print command is transferred from the control device 87 to the CPU 84 in S2, size data for the sheet 3 to be printed on, such as data indicating an A4-size sheet of sheet, is transmitted to the CPU 84 in S3 based on the results of the value detected by the sheet size sensor 88 in the feeder unit 4. In S4, image data is transferred and sequentially developed into a printing format that is stored in the RAM 86.

In S5, the electromagnetic solenoid 74 is switched to the energization phase (ON) and is then switched to the deenergization phase (OFF) in order to transmit a driving force to the sheet supply roller 12. As a result in S6, the sheet supply roller 12 rotates intermittently exactly one rotation, as described above. In S7, only the uppermost sheet of the sheet stack on the pressure plate 8 is drawn between the sheet supply roller 12 and separating pad 13*a* and is separated from the rest of the stack. The leading edge of the sheet 3 becomes interposed between the intermediate conveying rollers 10 immediately downstream. In this state, the sheet supply roller 12 on the upstream side of the intermediate conveying rollers 10 is idly rotated in S8, while the driving force of the intermediate conveying roller 10 conveys the sheet 3 downstream.

After a suitable time ÄT has elapsed while the sheet 3 is conveyed downstream, the leading edge of the sheet 3 passes the location of the register roller 9 and is brought into abutment with the image timing sensor 57 downstream of the register roller 9 in S9. At this time, laser light from the scanning unit 17 is irradiated on the photosensitive drum 23. Image data is written and an image is formed on the sheet 3 in S10 at the image forming position.

In S11, the trailing edge of the sheet of sheet 3 is determined to pass out of the frictional separating mechanism including the sheet supply roller 12 and separating pad 13*a* from the sheet size determined earlier. That is, the initially detected size of the sheet is used to determine the passing of the trailing edge out of the separating mechanism. The above described nipping area provides a downstream end in the sheet conveying direction. The CPU 84 judges complete pass of the trailing end of the sheet over the downstream end of the nipping area based on the data of the sheet size.

Directly thereafter, the CPU determines in S12 whether there remains any image data to be printed. If there is no remaining image data to be printed (S12:No), the printing process ends in S13.

If unprinted image data remains (S12:Yes), then the leading edge sensors 80 determine in S14 the position of the leading edge of the subsequent sheet 3. If the leading edge of the following sheet of sheet 3 has not reached the location of the leading edge sensors 80 (Not reached in S14) then the rotational driving of the sheet supply roller 12 is started in S15 at the normal sheet feed start timing (standard timing). In the present embodiment, the standard timing is designed to form an interval of 60 mm between sheets of sheet.

Conversely, if the subsequent sheet is also moved (not complete overlap manner with the precedent sheet but displaced manner) in the conveying direction due to attraction to the precedent sheet during the feeding of the precedent sheet, the precedent sheet is further conveyed toward the image forming position by the intermediate conveying rollers 11, 10, but the subsequent sheet is stopped while being nipped between the sheet supply roller 12 and the separation pad 13. In this case, the leading edge sensors 80 detect the leading edge of the subsequent sheet 3, indicating that the position of the leading edge of the subsequent sheet 3 has reached the location of the leading edge sensors 80 (Reached in S14) . This indicates that the interval between the preceding sheet of sheet 3 and the following sheet is less than the predetermined value. To increase the distance between neighboring sheets, the sheet feed start timing is delayed in S16 an amount of time equivalent to the distance L0 (7.5 mm in the present embodiment) from the reference position N to the pair of left and right leading edge sensors 80. After executing this control process for the sheet feed start timing, the process returns to S5 to print on the following sheet of sheet 3. Accordingly, the interval between the trailing edge of the preceding sheet and the leading edge of the subsequent sheet is not smaller than a predetermined value.

In the first embodiment described above, when a leading edge sensor 80 is disposed at only one location a suitable distance from the reference position N along the conveying direction, the amount of distance that the leading edge of the following sheet of sheet 3 deviates from the reference position N is set to a binary value based on whether or not the leading edge of the sheet to be conveyed next has reached the leading edge sensor 80.

If the leading edge sensors 80 are disposed at a plurality of positions at suitable intervals along the conveying direction in relation to the reference position N, it is possible to determine the amount that the leading edge of the sheet 3 deviates from the reference position N in the sheet 3 deviates from the reference position N in three stages or more. Accordingly, a control process can be performed to correct this deviation by offsetting the sheet feed start timing from the standard timing.

In the first embodiment, the start timing for feeding the sheet is adjusted according to detections by the sheet sensors in order that the interval between the trailing edge of the preceding sheet of sheet and the leading edge of the following sheet is not smaller than a predetermined value. When printing on a plurality of sheets of sheet in succession, this embodiment present invention can eliminate printing defects, such as printing images at inappropriate positions on the sheet of sheet, occurring when the interval between sheets is too small. Further, the first embodiment is capable of increasing the speed of the image formation in terms of the number of sheets per unit time.

Figure 7A:
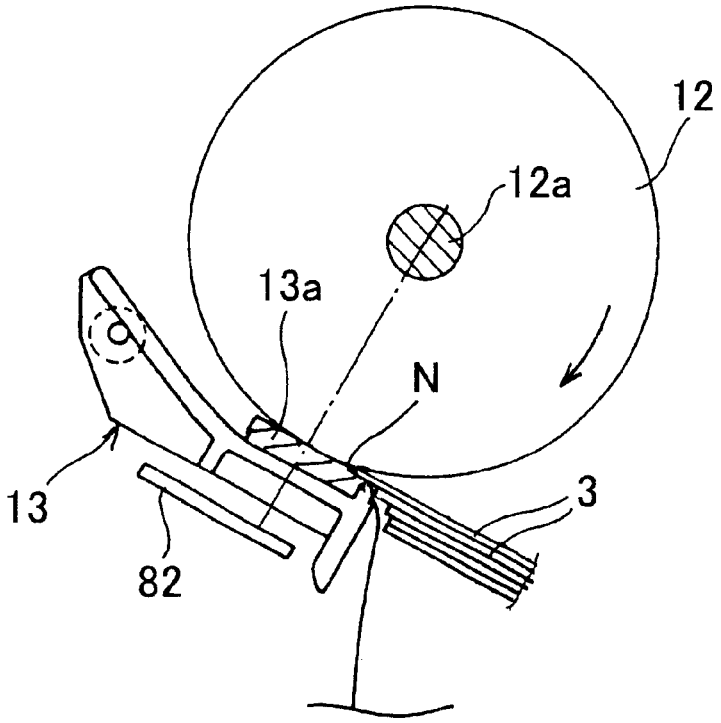
FIG. 7(*a*) is a side view showing a leading edge sensor according to a second embodiment of the present invention.
Figure 7B:
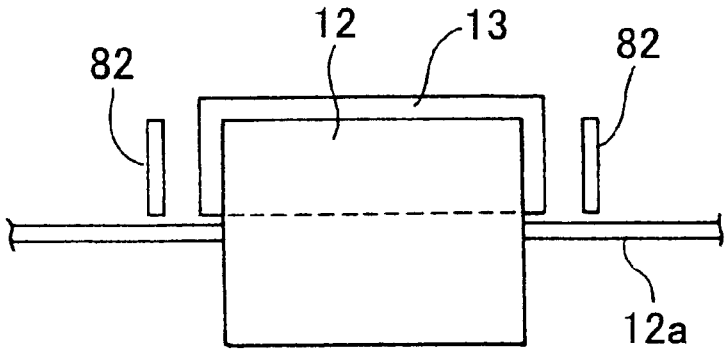

FIGS. 7(*a*) and 7(*b*) show the configuration of a second embodiment of the present invention in which the leading edge sensing device is a linear optical sensor 82 including a row of solid-state imaging sensing elements aligned in the sheet conveying direction and extending downstream from the reference position N. With this linear optical sensor 82, it is possible to measure in detail the amount that the leading edge of the sheet 3 deviates from the reference position N based on the number of solid-state imaging sensing elements covered by the sheet 3 downstream from the sheet separating position. Accordingly, it is possible to control the amount that the feed start timing is offset from the standard timing based on this measurement in proportion to the deviation length. In other words, the leading edge sensors can detect the distance of the leading edge of the sheet from the reference position in detail or in analog. Accordingly, it is possible to offset the feed start timing from the standard timing based on this distance, thereby improving control accuracy.

In place of the solid-state imaging sensing devices, another type of a sensor including a sensor lever and an analog detecting unit (variable resistance unit) is available. The sensor lever is pivotally movable in the sheet conveying direction about a pivot axis when contacted by the leading edge of the sheet, and the analog detecting unit is adapted for measuring the amount of angular pivotal movement of the sensor lever. In either case, the sensing unit can determine the deviation amount that the leading edge of the sheet deviates from the reference position N at the nip area or the separating position. The start timing for feeding the sheet is adjusted according to this measurement in order that the interval between the trailing edge of the preceding sheet 3 and the leading edge of the following sheet is not smaller than a predetermined value. When printing on a plurality of sheets 3 in succession, can be avoided printing defects such as printing images at inappropriate positions on the sheet, occurring when the interval between sheets is too small. Since it is not necessary to slow the print processing speed by setting the sheet feed start timing greater than is actually necessary for ensuring that data is developed in time and preventing the detection of sheet jams, as in conventional processes, it is possible to increase the number of sheets printed per minute (print processing speed) when printing on a plurality of sheets 3 in succession.

The leading edge sensors are configured to detect the distance of the leading edge of the sheet 3 from the reference position N. The controller 83 controls rotation start timing of the sheet supply roller 12, i.e., sheet supply start timing. The control is made by offsetting the feed start timing for driving the sheet supply roller 12 from a reference feed start timing based on the detected distance of the leading edge of the sheet 3 from the reference position. By detecting the distance of the leading edge of the sheet 3 from the reference position in detail or in analog like manner, it is possible to offset the feed start timing from the standard timing based on the distance, thereby improving control accuracy.

By providing the feeding unit with the separating pad 13*a* opposing the sheet supply roller 12 and setting the reference position on the upstream end of the nip area between the sheet supply roller 12 and separating pad 13*a* in the conveying direction of the sheet 3, only the leading edge sensors need be disposed downstream from the reference position. Accordingly, the installation number and length of leading edge sensors can be reduced, creating a more compact device.

If leading edge sensors are disposed on the underside of the frictional separating pad, the feeding unit can be made more compact.

Leading edge sensors 80 can also be provided at an upstream side of the reference position N. That is, leading edge sensors are provided at both downstream and upstream sides of the reference position N. The feed start timing can be delayed from the standard timing when the leading edge of the sheet 3 is offset downstream from the reference position N as a result of detection by the downstream side sensor(s) 80. On the other hand, the feed start timing can be set quicker than the standard timing when the leading edge is offset upstream from the reference position N, as a result of detection by the upstream side sensor(s) 80. Accordingly, the interval between sheets does not become too large, but can be maintained at a substantially uniform amount.

The embodiments described above employ a frictional separating type feeding unit in which a frictional separating pad formed of a material having a high coefficient of friction is positioned in opposition to the circumferential surface of the sheet supply roller 12. However, the present invention can also be applied to a feeding unit having a bank-type separating mechanism. In the latter feeding unit, a sheet supply roller is placed in contact with an uppermost sheet of the sheet stack, and a bank member is positioned approximately orthogonal to the sheet conveying path for blocking the sheet. When the sheet supply roller is driven to rotate, the uppermost sheet can ride over the bank member by making use of linear orientation nature of the sheet after flexure.

While the invention has been described with reference to the specific embodiments thereof, it would be apparent to those skilled in the art that various changes and modifications may be made therein without departing from the scope of the invention.

What is claimed is:

1. An image forming device comprising:

an image forming unit at which an image is formed on an image recording medium;

a feeder unit accommodating a stack of a plurality of image recording mediums, the feeder unit comprising a sheet supply member that separates one image recording medium from a remaining stack, and feeds each one image recording medium toward the image forming unit in succession in a medium feeding direction with an interval between a trailing edge of a precedent image recording medium and a leading edge of a subsequent image recording medium;

a leading edge sensor detecting each leading edge of each uppermost image recording medium stacked in the feeder unit; and a control unit with which the leading edge sensor is communicated, the control unit controlling a driving timing of the sheet supply member for controlling a feed start timing to feed the image recording medium in the medium feeding direction based on the detection by the leading edge sensor, the detection being performed before driving the sheet supply member.

2. The image forming device as claimed in claim 1, wherein the feeder unit defines a reference position therein;

and wherein the control unit comprises retarding means that delays the driving timing if the leading edge sensor detects that the leading edge of the image recording medium is displaced from the reference position toward a downstream side thereof in the medium feeding direction.

3. The image forming device as claimed in claim 2, wherein the sheet supply member comprises a sheet supply roller;

and wherein the feeder unit further comprises a frictional separation member disposed in opposition to the sheet supply roller, the sheet supply roller and the separation member providing a nipping area for nippingly conveying each one image recording medium, the nipping area having an upstream end in the medium feeding direction at which the reference position is set.

4. The image forming device as claimed in claim 2, wherein the control unit further comprises accelerating means that accelerates the driving timing if the leading edge sensor detects that the leading edge of the image recording medium is displaced from the reference position toward an upstream side thereof in the medium feeding direction.

5. The image forming device as claimed in claim 1, wherein the feeder unit defines a reference position therein;

and wherein the control unit comprises accelerating means that accelerates the driving timing if the leading edge sensor detects that the leading edge of the image recording medium is displaced from the reference position toward an upstream side thereof in the medium feeding direction.

6. The image forming device as claimed in claim 1, wherein the feeder unit defines a reference position therein;

and wherein the leading edge sensor comprises a plurality of sensing elements arrayed in line in the medium feeding direction for detecting a distance between the reference position and the leading edge of the image recording medium, the control means controlling the drive timing based on the distance.

7. The image forming device as claimed in claim 6, wherein the sheet supply member comprises a sheet supply roller;

and wherein the feeder unit further comprises a frictional separation member disposed in opposition to the sheet supply roller, the sheet supply roller and the separation member providing a nipping area for nippingly conveying each one image recording medium, the nipping area having an upstream end in the medium feeding direction at which the reference position is set.

8. The image forming device as claimed in claim 1, wherein the sheet supply member comprises a sheet supply roller;

and wherein the feeder unit further comprises a frictional separation member disposed in opposition to the sheet supply roller, the sheet supply roller and the separation member providing a nipping area for nippingly conveying each one image recording medium, the nipping area having an upstream end in the medium feeding direction at which a reference position is set.

9. The image forming device as claimed in claim 8, wherein the leading edge sensor is disposed at the separation member.

10. The image forming device as claimed in claim 1, further comprising a sheet size sensor connected to the control unit for transmitting data indicative of a size of the image recording medium.

11. The image forming device as claimed in claim 10, wherein the feeder unit further comprises a frictional separation member disposed in opposition to a sheet supply roller, the sheet supply roller and the separation member providing a nipping area for nippingly conveying each one image recording medium, the nipping area having an upstream end in the medium feeding direction at which a reference position is set, the nipping area having a downstream end; and wherein the control unit comprises:

first judging means that judges a position of the leading edge of the image recording medium as a result of the detection by the leading edge sensor; and second judging means that judges complete pass of the trailing edge of the image recording medium over the downstream end of the nipping area based on the data indicative of size of the image recording medium.

12. The image forming device as claimed in claim 11, wherein the control unit further comprises third judging means that judges whether or not image data for a subsequent printing is remaining after the second judging means judges that the trailing end of the image recording medium has passed over the downstream end, the first judging means making judgment if the third judging means judges that there is a remaining image data.

* * * * *